US011444396B2

(12) United States Patent
Ji et al.

(10) Patent No.: US 11,444,396 B2
(45) Date of Patent: Sep. 13, 2022

(54) BOARD-TO-BOARD RADIO FREQUENCY PLUG AND RECEPTACLE

(71) Applicant: KUNSHAN EVERWIN PRECISION TECHNOLOGY CO., LTD, Jiangsu (CN)

(72) Inventors: Yabin Ji, Jiangsu (CN); Fengjin Yu, Jiangsu (CN)

(73) Assignee: KUNSHAN EVERWIN PRECISION TECHNOLOGY CO., LTD, Jiangsu (CN)

( * ) Notice: Subject to any disclaimer, the term of this patent is extended or adjusted under 35 U.S.C. 154(b) by 0 days.

(21) Appl. No.: 17/043,528

(22) PCT Filed: Jun. 27, 2019

(86) PCT No.: PCT/CN2019/093186
§ 371 (c)(1),
(2) Date: Sep. 29, 2020

(87) PCT Pub. No.: WO2020/052318
PCT Pub. Date: Mar. 19, 2020

(65) Prior Publication Data

US 2021/0242617 A1 Aug. 5, 2021

(30) Foreign Application Priority Data

Sep. 12, 2018 (CN) ..... 201811061516.1

(51) Int. Cl.
*H01R 12/71* (2011.01)
*H01R 13/50* (2006.01)
(Continued)

(52) U.S. Cl.
CPC ..... *H01R 12/716* (2013.01); *H01R 13/50* (2013.01); *H01R 13/6581* (2013.01);
(Continued)

(58) Field of Classification Search
CPC .. H01R 12/716; H01R 13/50; H01R 13/6581; H01R 13/6585; H01R 13/6592;
(Continued)

(56) References Cited

U.S. PATENT DOCUMENTS 4,632,476 A 12/1986 Schell
5,938,450 A 8/1999 Nagafuji
(Continued)

FOREIGN PATENT DOCUMENTS

CN 101114746 A1 1/2008
CN 101667695 A1 3/2010
(Continued)

OTHER PUBLICATIONS

International Search Report and Written Opinion in International Application No. PCT/CN2019/093186 (dated Sep. 27, 2019).

*Primary Examiner* — Abdullah A Riyami
*Assistant Examiner* — Justin M Kratt
(74) *Attorney, Agent, or Firm* — W&G Law Group

(57) ABSTRACT

Provided is a board-to-board radio frequency plug, including a plug body; a plurality of plug terminals and a plurality of metal spacers integrally formed in the plug body; and a shielding shell wrapping the plug body and the plurality of plug terminals. The plug body comprises: a body base; a body outer-wall formed by integrally extending upward from a periphery of the body base; an island portion formed by integrally extending upward from middle of the body base; and an insertion space formed between the body outer-wall and the island portion. The plug terminals extend on an outer periphery of the island portion, each metal spacer is provided between two adjacent ones of the plurality of plug terminals, and each metal spacers penetrates through the island portion and the insertion space in a
(Continued)

perpendicular direction. The present disclosure further provides a board-to-board radio frequency receptacle.

20 Claims, 9 Drawing Sheets

(51) Int. Cl.

| | |
|---|---|
| ***H01R 13/6581*** | (2011.01) |
| ***H01R 13/6585*** | (2011.01) |
| *H01R 12/53* | (2011.01) |
| *H01R 13/658* | (2011.01) |
| *H01R 13/648* | (2006.01) |
| *H01R 13/6592* | (2011.01) |
| *H01R 13/46* | (2006.01) |
| *H01R 13/24* | (2006.01) |
| *H01R 12/75* | (2011.01) |
| *H01R 13/02* | (2006.01) |

(52) U.S. Cl.
CPC ..... *H01R 13/6585* (2013.01); *H01R 12/53* (2013.01); *H01R 12/75* (2013.01); *H01R 13/02* (2013.01); *H01R 13/2435* (2013.01); *H01R 13/46* (2013.01); *H01R 13/648* (2013.01); *H01R 13/658* (2013.01); *H01R 13/6592* (2013.01)

(58) Field of Classification Search
CPC .... H01R 13/648; H01R 13/658; H01R 12/53; H01R 13/2435; H01R 12/75; H01R 13/02; H01R 13/46
See application file for complete search history.

(56) References Cited

U.S. PATENT DOCUMENTS

| | | | |
|---|---|---|---|
| 6,666,696 | B1 | 12/2003 | Wu |
| 2006/0003639 | A1 | 1/2006 | Ishizuka et al. |

FOREIGN PATENT DOCUMENTS

| | | | | | |
|---|---|---|---|---|---|
| CN | 201430243 | Y | | 3/2010 | |
| CN | 104300316 | A | | 1/2015 | |
| CN | 104810691 | A1 | | 7/2015 | |
| CN | 204947248 | A1 | | 1/2016 | |
| CN | 105990767 | A | | 10/2016 | |
| CN | 108155499 | A1 | | 6/2018 | |
| CN | 108418022 | A | * | 8/2018 | ..... H01R 12/716 |
| CN | 108418022 | A1 | | 8/2018 | |
| CN | 108511997 | A | * | 9/2018 | |
| CN | 108511997 | A1 | | 9/2018 | |
| CN | 109217031 | A1 | | 1/2019 | |
| WO | WO2013062823 | A1 | | 5/2013 | |

* cited by examiner

BOARD-TO-BOARD RADIO FREQUENCY PLUG AND RECEPTACLE

CROSS-REFERENCE TO RELATED APPLICATIONS

This patent application is a U.S. national phase of International Application No. PCT/CN2019/093186, filed on Jun. 27, 2019, which claims priority to Chinese Patent Application No. 201811061516.1, filed on Sep. 12, 2018. The disclosures of the aforementioned applications are hereby incorporated by reference in their entireties.

TECHNICAL FIELD

The present disclosure relates to the field of radio frequency connectors and, in particular, to board-to-board radio frequency plug and receptacle.

BACKGROUND

PCB boards of existing mobile phones are usually provided with a radio frequency connector connected to a coaxial cable in order to transmit radio frequency signals such as antenna signals, high frequency signals between different boards, etc.

5G communication technology is approaching, a frequency will be further increased, an existing technical solution where one coaxial cable is used to transmit radio frequency signals can no longer meet capacity requirements, and the increase in frequency has stricter requirements for interference between high-frequencies, besides, crosstalk between a plurality of radio frequency signals also needs a solution. Chinese Patent Application No. 201711263342.2 discloses a board-to-board radio frequency plug, receptacle and an assembly thereof, and during a testing process, the above-mentioned products still had a defect of sub standard isolation.

SUMMARY

In view of this, it needs to provide a board-to-board radio frequency plug and a receptacle that have large installation plug-in space under an ultra-thin dimension in order to facilitate installation and disassembly operations.

In order to solve the above technical problem, the present disclosure provides a board-to-board radio frequency plug, including a plug body; a plurality of plug terminals and a plurality of metal spacers integrally formed in the plug body; and a shielding shell wrapping the plug body and the plurality of plug terminals. The plug body includes: a body base; a body outer-wall formed by integrally extending upward from a periphery of the body base; an island portion formed by integrally extending upward from middle of the body base; and an insertion space formed between the body outer-wall and the island portion. The plurality of plug terminals extend on an outer periphery of the island portion, each of the plurality of metal spacers is provided between two adjacent ones of the plurality of plug terminals, and each of the plurality of metal spacers penetrates through the island portion and the insertion space in a perpendicular direction.

Preferably, an outer periphery of the body base extends outward to form a platform portion, a covering portion is formed on a side of the body base where the plug terminal extends out, and the body base extends on a side opposite to the covering portion to form a protruding portion.

Preferably, the shielding shell includes a substrate, a first covering portion formed by being bent and extending in an opposite direction from a side of the substrate, and a cover plate parallel to the substrate and formed by being bent and extending perpendicularly from the first covering portion; an opening is formed in the cover plate, and a periphery of the opening is provided, by stamping, with a protective portion wrapping an outer periphery of the body outer-wall.

Preferably, four corners of the protective portion is further provided with first buckling portions.

Preferably, the shielding shell further includes a second covering portion formed by being perpendicularly bent and extending from a lateral outer side of the substrate toward the cover plate, an opening formed in the cover plate and configured for exposing the plug body and the plurality of plug terminals of the plug to outside, and cable clamps formed outside of the substrate and the cover plate by stamping.

Preferably, the second covering portion includes a vertical covering portion formed by being perpendicularly bent from the substrate, and a buckling portion which is overlapped on lateral two sides of an upper surface of the cover plate and formed by being perpendicularly bent and extending from a tip end of the vertical covering portion; and the buckling portion is located on outside of the protective portion and cut to form an avoiding portion, and the avoiding portion extends on two sides to form buckling protrusions, so as to enhance buckling firmness of the shielding shell.

Preferably, each of the plurality of plug terminals includes a first welding pin and a first U-shaped contact portion formed by being bent from an end of the first welding pin, the first U-shaped contact portion is buckled outside the island portion, and the first U-shaped contact portion includes two contact portions located on an outer surface of a vertical portion of the island portion, and a hook portion embedded in the island portion in a direction perpendicular to a plug-in direction.

Preferably, each of the plurality of metal spacer includes a shielding body located outside the first U-shaped contact portion, an extending end extending from the shielding body to the covering portion, and a positioning end extending from the shielding body toward the protruding portion; and the shielding body penetrates through the island portion in the perpendicular direction and completely isolates the insertion space in the perpendicular direction.

Preferably, a plurality of groove structures for receiving the first welding pins of the plurality of plug terminals are provided at top of the covering portion, and each of the plurality of groove structures corresponds to a respective one of the first welding pins; and a baffle is formed between the groove structures, the first welding pin extends from a side of the body base to the groove structure of the covering portion, and the extending end of the metal spacer is formed in the baffle.

Preferably, central conductors of a plurality of coaxial cables are welded to the first welding pins in the plurality of groove structures, an insulating bar is pressed over the plurality of groove structures, and the insulating bar and the covering portion are sandwiched and fixed by the substrate and the cover plate.

Preferably, the plurality of the metal spacers are connected into one piece through a material strip through the positioning ends, which are formed in the protruding portion of the plug body, and after injection molding, the connected material strip is cut out, so that the plurality of metal spacers are electrically isolated from each other.

In order to solve the above technical problem, the present disclosure further provides a board-to-board radio frequency plug, including a plug body; a plurality of plug terminals and a plurality of metal spacers integrally formed in the plug body; and a shielding shell wrapping the plug body and the plurality of plug terminals. The plug body includes: a body base; a body outer-wall formed by integrally extending upward from a periphery of the body base; an island portion formed by integrally extending upward from middle of the body base; and an insertion space formed between the body outer-wall and the island portion. The plurality of plug terminals extend on an outer periphery of the island portion; the shielding shell includes a substrate, a first covering portion formed by being reversely bent and extending from a side of the substrate, and a cover plate parallel to the substrate and formed by being bent and extending perpendicularly from the first covering portion; and an opening is formed in the cover plate, and a periphery of the opening is provided, by stamping, with a protective portion wrapping an outer periphery of the body outer-wall.

Preferably, each of the plurality of metal spacers is provided between two adjacent ones of the plurality of plug terminals, and each of the plurality of metal spacers penetrate through the island portion and the insertion space in a perpendicular direction.

Preferably, an outer periphery of the body base extends outward to form a platform portion, a covering portion is formed on a side of the body base where the plug terminal extends out, and the body base extends on a side opposite to the covering portion to form a protruding portion.

Preferably, four corners of the protective portion are further provided with first buckling portions.

Preferably, the shielding shell further includes a second covering portion formed by being perpendicularly bent and extending from a lateral outer side of the substrate toward the cover plate, an opening formed in the cover plate and configured for exposing the plug body and the plurality of plug terminals of the plug to outside, and cable clamps formed outside of the substrate and the cover plate by stamping.

Preferably, the second covering portion includes a vertical covering portion formed by being perpendicularly bent from the substrate, and a buckling portion which is overlapped on lateral two sides of an upper surface of the cover plate and formed by being perpendicularly bent and extending from a tip end of the vertical covering portion; and the buckling portion is located on outside of the protective portion and cut to form an avoiding portion, and the avoiding portion extends on two sides to form buckling protrusions, so as to enhance buckling firmness of the shielding shell.

Preferably, each of the plurality of plug terminals includes a first welding pin and a first U-shaped contact portion formed by being bent from an end of the first welding pin, the first U-shaped contact portion is buckled outside the island portion, and the first U-shaped contact portion includes two contact portions located on an outer surface of a vertical portion of the island portion, and a hook portion embedded in the island portion in a direction perpendicular to a plug-in direction.

Preferably, each of the plurality of metal spacers includes a shielding body located outside the first U-shaped contact portion, an extending end extending from the shielding body to the covering portion, and a positioning end extending from the shielding body toward the protruding portion; the shielding body penetrates through the island portion in the perpendicular direction and completely isolates the insertion space in the perpendicular direction; the plurality of the metal spacers are connected into one piece through a material strip through the positioning ends, which are formed in the protruding portion of the plug body, and after injection molding, the connected material strip is cut out, so that the plurality of metal spacers are electrically isolated from each other Preferably, a plurality of groove structures for receiving the first welding pins of the plurality of plug terminals are provided at top of the covering portion, and each of the plurality of groove structures corresponds to a respective one of the first welding pins; and a baffle is formed between the groove structures, the first welding pin extends from a side of the body base to the groove structure of the covering portion, and the extending end of the metal spacer is formed in the baffle.

Preferably, central conductors of a plurality of coaxial cables are welded to the first welding pins in the plurality of groove structures, an insulating bar is pressed over the plurality of groove structures, and the insulating bar and the covering portion are sandwiched and fixed by the substrate and the cover plate.

In order to solve the above technical problem, the present disclosure further provides a board-to-board radio frequency receptacle, including a receptacle body; a receptacle fixing member integrally formed on the receptacle body; and a receptacle terminal provided in the receptacle body. The receptacle body includes: a body bottom plate; a fence formed by integrally extending upward from the body bottom plate; a mating cavity provided in the fence; a terminal groove penetrating through the body bottom plate and communicating with the mating cavity; and a bottom plate extending portion formed by extending outward from the body bottom plate. The fence is cut in an extending direction of the receptacle terminal to form a plurality of matching grooves, and each of the plurality of matching grooves penetrates through the fence and passes through the mating cavity in the extending direction of the receptacle terminal.

Preferably, the receptacle terminal is integrally formed in the terminal groove, the receptacle terminal includes a second welding pin, a second U-shaped contact portion formed by being bent multiple times from one an end of the second welding pin, an end formed by being reversely bent from a tip end of the second U-shaped contact portion; and two contact portions of the second U-shaped contact portion are located on opposite wall surfaces of the mating cavity.

Preferably, the receptacle fixing member includes a frame structure, a welding portion formed by extending from bottom of the frame structure, and second buckling portions provided at four corners of the frame structure; and an accommodation gap is formed between the fence of the receptacle body and the frame structure.

In the present disclosure, the plug terminal and the metal spacer are integrally formed in the plug body by in-mold injection molding, such that every two plug terminals are separated by the metal spacer, and a better isolation index can be obtained.

BRIEF DESCRIPTION OF DRAWINGS

The accompanying drawings described herein are used to provide a further illustration of the present disclosure and constitute a part of the present disclosure, and illustrative embodiments of the present disclosure and the description thereof are used to explain the present disclosure and do not constitute an improper limitation on the present disclosure. In the accompanying drawings.

BRIEF DESCRIPTION OF DRAWINGS

In order to make the purpose, technical solutions and advantages of the present disclosure clearer, the technical solutions of the present disclosure will be described in details as follows in combination with specific embodiments and the corresponding drawings of the present disclosure. The described embodiments are merely a part of the embodiments of the present disclosure, rather than all the embodiments. Based on the embodiments of the present disclosure, all other embodiments obtained by those skilled in the art without creative work shall fall within a protection scope of the present disclosure.

Figure 1:
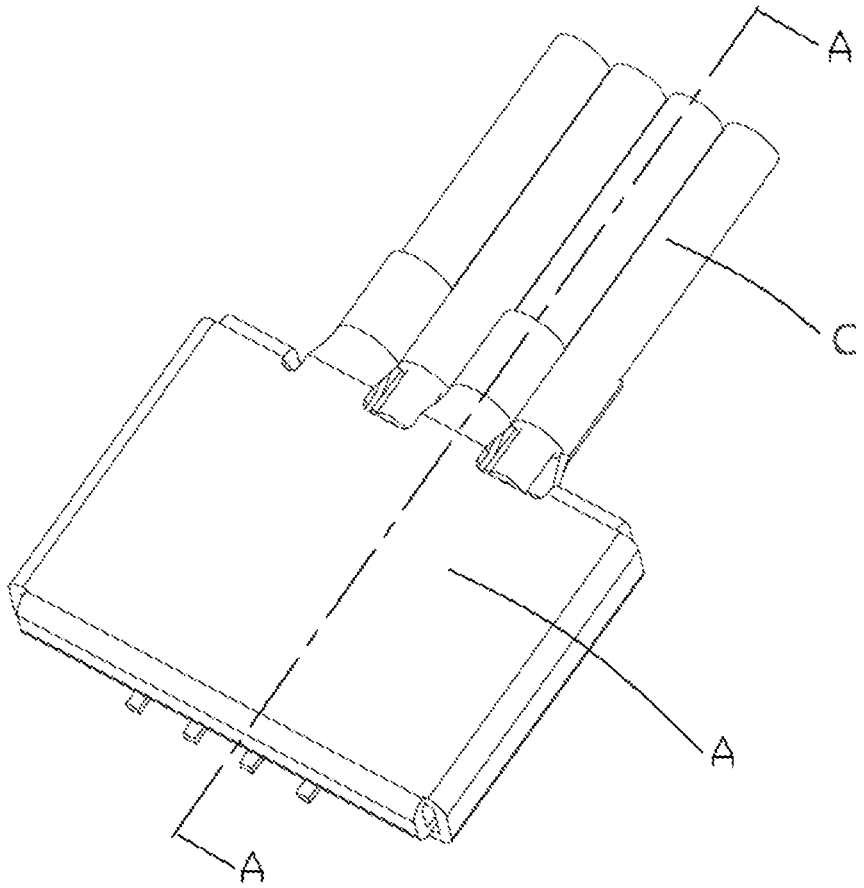
FIG. 1 is a perspective assembly diagram of a radio frequency connector of the present disclosure.
Figure 2:
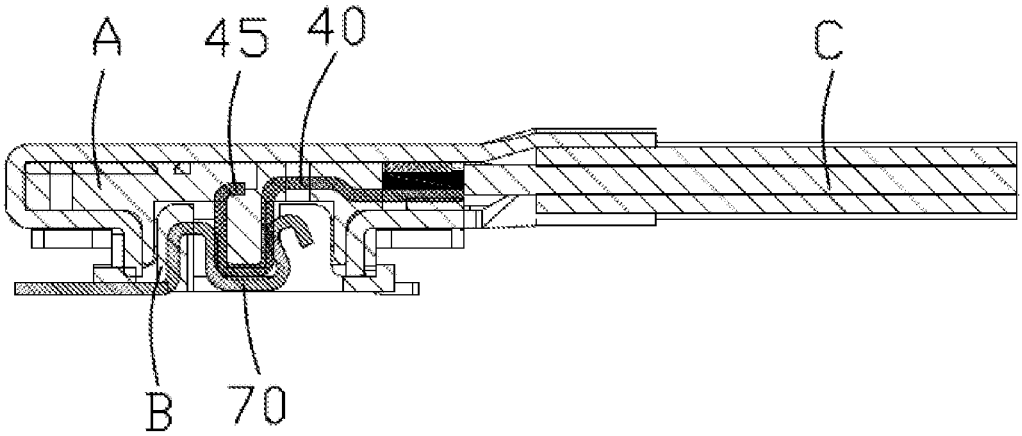
FIG. 2 is a cross-sectional view along a broken line A-A shown in FIG. 1.
Figure 3:
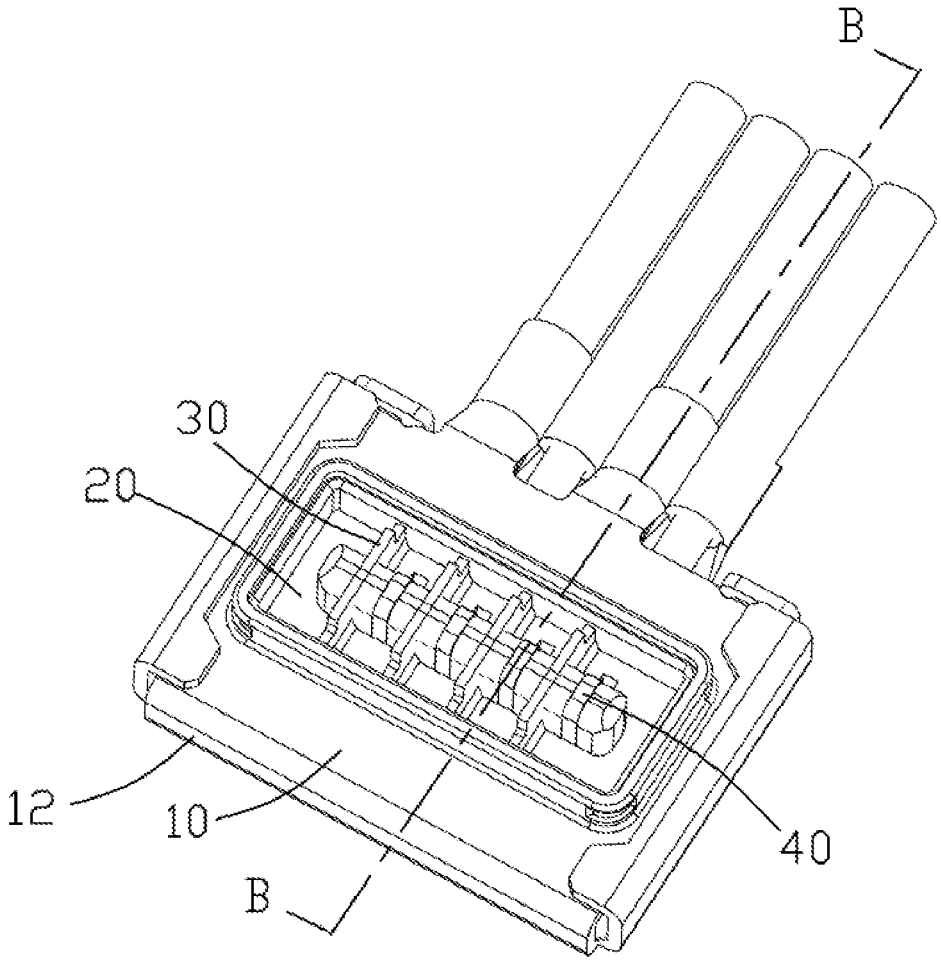
FIG. 3 is a perspective view of a plug of the present disclosure.

Referring to FIGS. 1 and 2, a radio frequency connector assembly of the present disclosure includes a receptacle B, a plug A mated to the receptacle B, and a coaxial cable C connected to the plug A.

Referring to FIGS. 2-9, the plug A includes a plug body 20, a plurality of plug terminals 40 inserted or formed in the plug body 20, a plurality of metal spacers 30 formed in the plug body 20 to isolate the plug terminals 40, and a shielding shell 10 wrapping the plug body 20.

Figure 5:
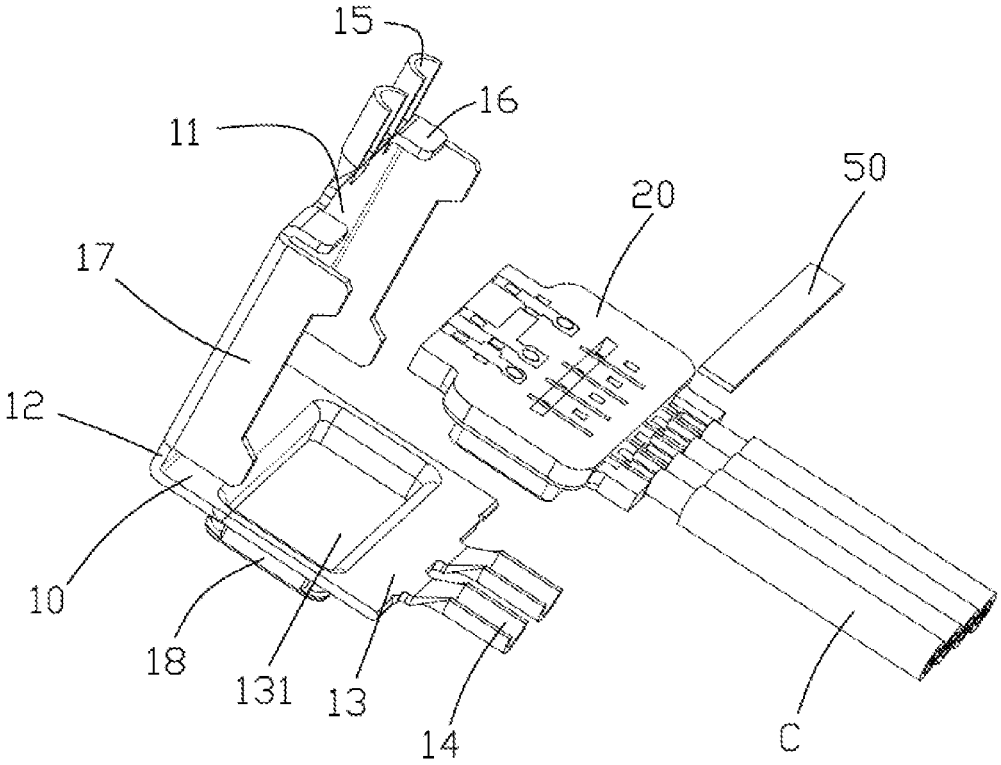
FIG. 5 is a perspective exploded view of a plug of the present disclosure.
Figure 6:
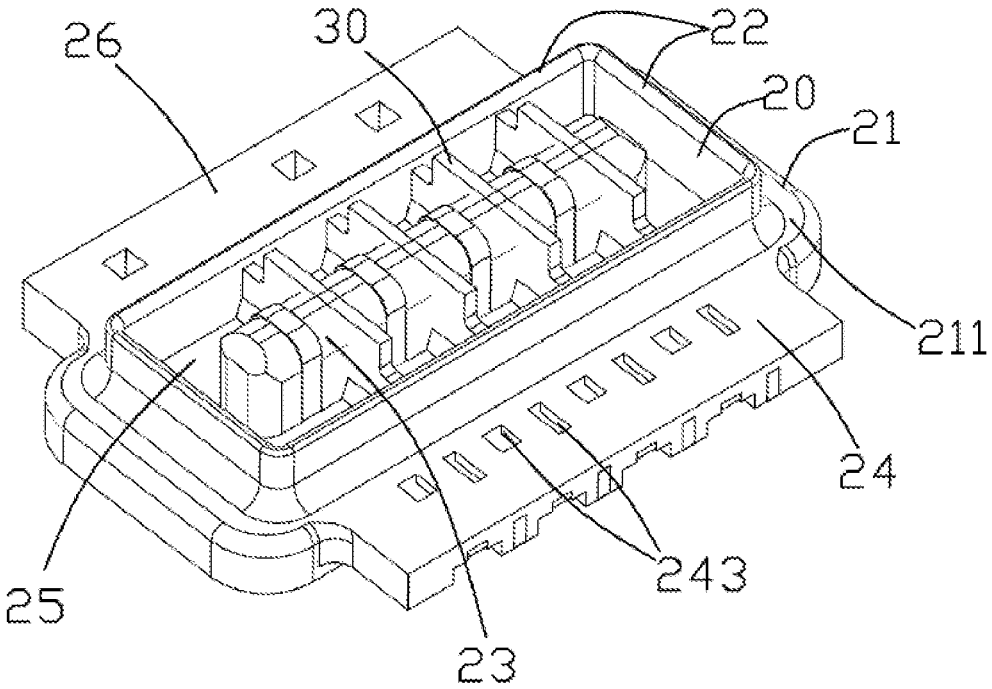
FIG. 6 is a perspective view of a plug of the present disclosure with a plug shell being removed.
Figure 7:
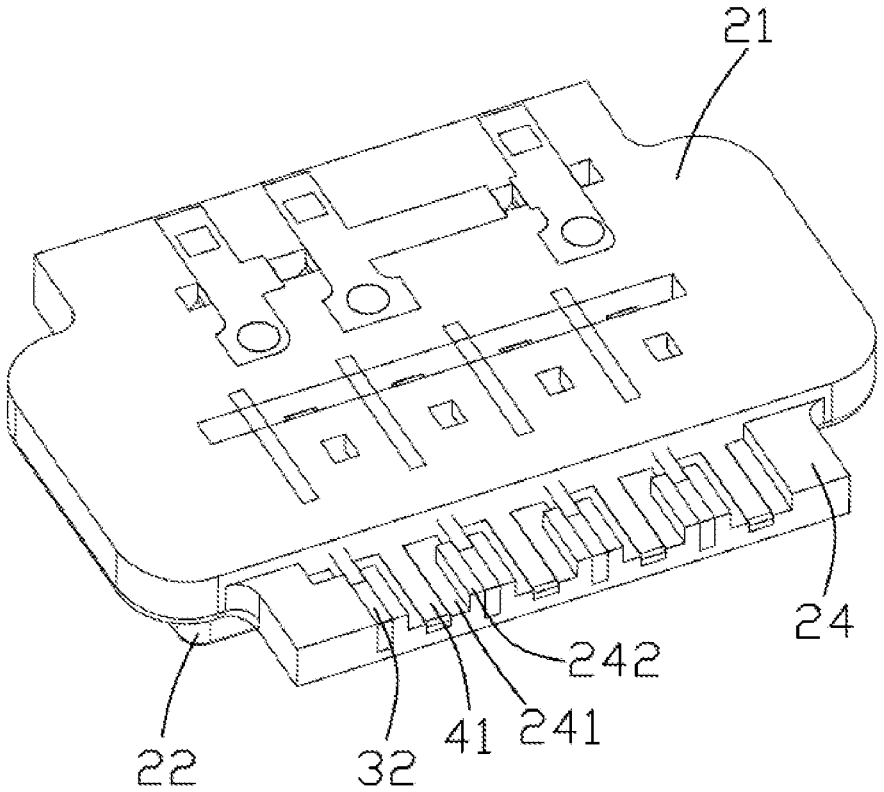
FIG. 7 is a perspective view of a plug of the present disclosure from another angle with a plug shell being removed.

Focusing on FIGS. 5 to 7, the plug body 20 includes a body base 21, a body outer-wall 22 formed by integrally extending upward from a periphery of the body base 21, an island portion 23 formed by integrally extending upward from middle of the body base 21, and an insertion space 25 formed between the body outer-wall 22 and the island portion 23. An outer periphery of the body base 21 extends outward to form a platform portion 211, a covering portion 24 is formed on a side of the body base 21 where the plug terminals 40 extend out, and a plurality of fixing holes 243 for fixing the plug terminals 40 during molding are formed in bottom of the covering portion 24. A protruding portion 26 is formed, by extending, on a side of the body base 21 opposite to the covering portion 24.

Figure 4:
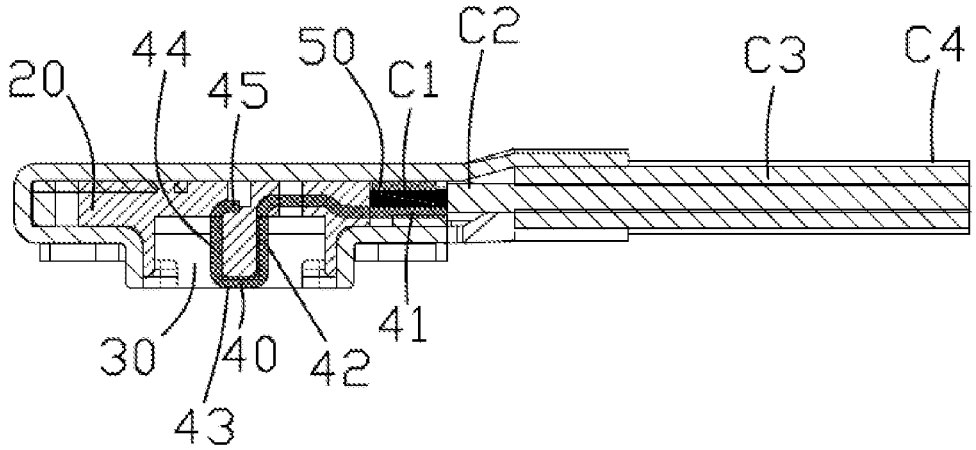
FIG. 4 is a cross-sectional view along a broken line B-B shown in FIG. 3.
Figure 8:
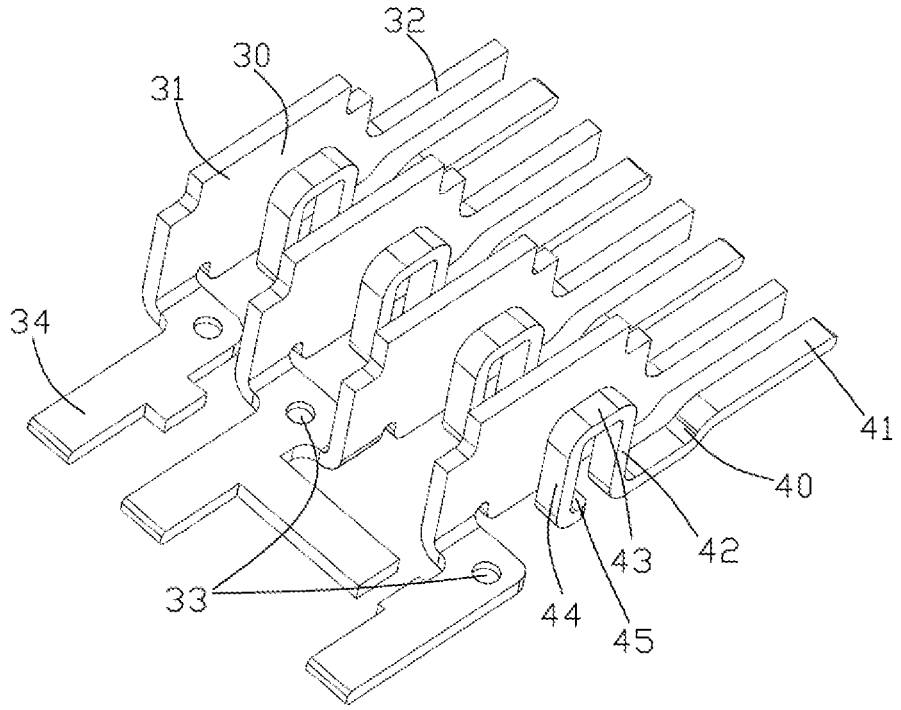
FIG. 8 is a perspective view of a plug terminal and a spacer of a plug of the present disclosure.

As shown in FIGS. 4, 5, and 8, the plug terminal 40 includes a first welding pin 41 and a first U-shaped contact portion 43 formed by being bent from an end of the first welding pin 41. The first U-shaped contact portion 43 is buckled outside the island portion 23, and the first U-shaped contact portion 43 includes two contact portions 42, 44 located on an outer surface of a vertical portion of the island portion 23, and a hook portion 45 embedded in the island portion 23 in a direction perpendicular to a plug-in direction. The first welding pin 41 extends from a side of the body base 21 to the covering portion 24, a plurality of groove structures 241 for receiving the first welding pins 41 of the plug terminals 40 are provided at top of the covering portion 24, each of the groove structures 241 corresponds to one first welding pin 41, and a baffle 242 is formed between the groove structures 241.

The coaxial cable C includes a central conductor C1 that is electrically connected to the first welding pin 41 in the groove structure 241, a first insulating layer C2 wrapping outside the central conductor C 1, a shielding braided layer C3 wrapping a periphery of the first insulating layer C2, and a second insulating layer C4 wrapping outside the shielding braided layer C3. An insulating bar 50 is pasted above the groove structure 241, and the insulating bar 50 is pressed over the groove structure 241 by the shielding shell 10, in order to electrically isolate the central conductor Cl from the shielding shell 10.

The metal spacer 30 includes a shielding body 31 located outside the first U-shaped contact portion 43, an extending end 32 extending from the shielding body 31 to the covering portion 24, and a positioning end 34 extending from the shielding body 31 toward the protruding portion 26. The extending end 32 is formed in the baffle 242 located on each of both sides of the groove structure 241, and a surface of the extending end 32 is flush with an upper surface of the baffle 242. The positioning end 34 is formed by being perpendicularly bent from the shielding body 31 and then extending in parallel. The positioning ends 34A are provided with a plurality of hole structures 33. The positioning ends 34 are connected as a whole before injection molding and connected with a material strip, and after the injection molding, connection is cut to separate the metal spacer 30. The hole structure 33 is exposed from a lower surface of the body base 21 to receive solder grounding.

The shielding body 31 penetrates through the plug body 20 in an up and down direction, and the shielding body 31 penetrates through the insertion space 25 and the island portion 23 in an extending direction of the cable C in order to completely shield interference between the plug terminals 40.

Figure 9:
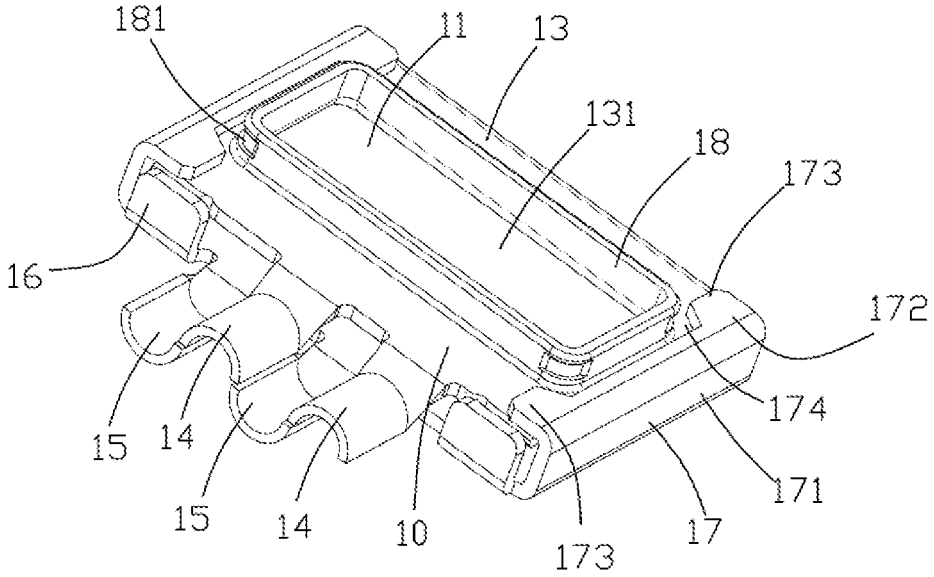
FIG. 9 is a perspective view of a plug shell of a plug of the present disclosure.
Figure 10:
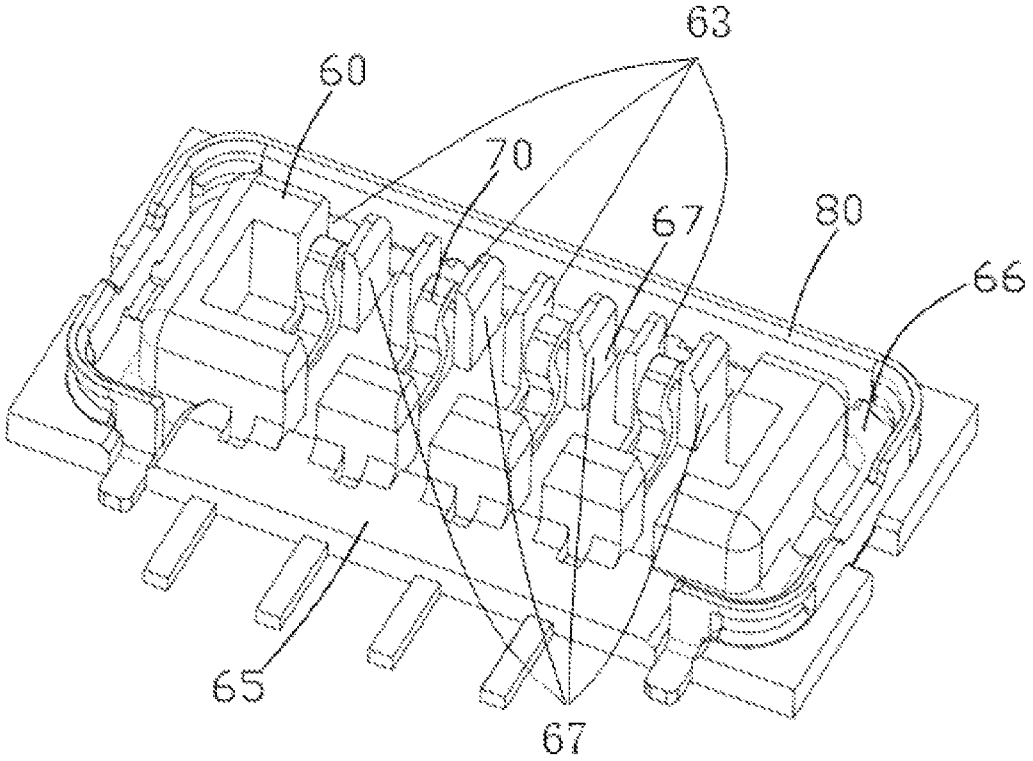
FIG. 10 is a perspective view of a receptacle of the present disclosure.
Figure 11:
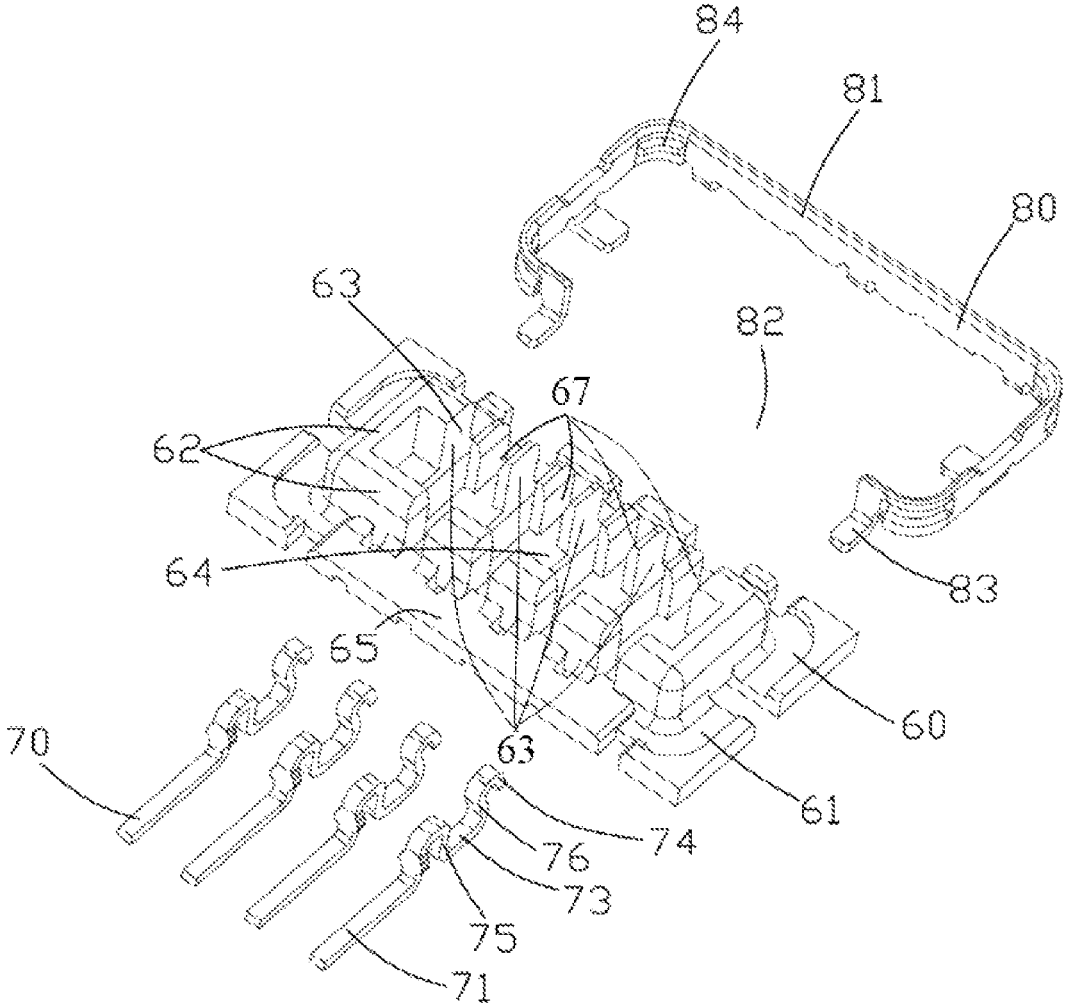
FIG. 11 is a perspective exploded view of a receptacle of the present disclosure.

Referring to FIGS. 5 and 9, the shielding shell 10 includes a substrate 11, a first covering portion 12 formed by being bent and extending in an opposite direction from a side of the substrate 11, a cover plate 13 parallel to the substrate 11 and formed by being bent and extending perpendicularly from the first covering portion 12, a second covering portion 17 formed by being perpendicularly bent and extending from a lateral outer side of the substrate 11 toward the cover plate 13, an opening 131 formed in the cover plate 13 and configured for exposing the plug body 20 and the plug terminal 40 of the plug A to outside, and cable clamps 14, 16 formed outside of the substrate 11 and the cover plate 13 by stamping. The cable clamps 14 and 16 are alternately arranged on the substrate 11 and the cover plate 13. The cable clamps 14 and 16 are used to sandwich the coaxial cable C. The cable clamps 14, 16 are connected end to end, so that two adjacent cables are shielded from each other.

An outer periphery of the opening 131 of the cover plate 13 is further provided, by stamping, with a protective portion 18 for wrapping and protecting the periphery of the body outer-wall 22 of the plug body 20, and the protective portion 18 protrudes from a surface of the cover plate 13. First buckling portions 181 are provided at diagonal corners of the protective portion 18.

The second covering portion 17 includes a vertical covering portion 171 formed by being perpendicularly bent from the substrate 11, and a buckling portion 172 which is overlapped on the lateral two sides of the upper surface of the cover plate 13 and formed by being perpendicularly bent and extending from a tip end of the vertical covering portion 171. The buckling portion 172 is located on the outside of the protective portion 18 and cut to form an avoiding portion 174, and the avoiding portion 174 extends on two sides to form buckling protrusions 173, in order to enhance the buckling firmness of the shielding shell 10.

Each of two ends of the substrate 11 close to the cable clamp 15 are bent toward the cover plate 13 to form a third covering portion 16.

The plug terminal 40 and the metal spacer 30 are integrally formed in the plug body by in-mold injection molding, such that every two plug terminals 40 are separated by the metal spacer 30, and a better isolation index can be obtained.

The extending end 32 and the positioning end 34 of the metal spacer 30 are respectively connected by the material strip, and the positioning end 34 of the metal spacer 30 is formed in the protruding portion 26 of the plug body, and after the injection molding, the metal spacers 30 are electrically disconnected by cutting. With the protruding portion 26, bonding between the metal spacer 30 and the plug body 20 is stronger.

The plug A is completely enclosed in the shielding shell 10 except a mating interface with the receptacle B, such that high-frequency signals are completely shielded in the shielding shell 10 without affecting electronic components in smart phones.

Referring to FIG. 1, FIG. 2 and FIG. 10, FIG. 11, the receptacle B includes a receptacle body 60, a receptacle fixing member 80 integrally formed on the receptacle body 60, and a receptacle terminal 70 installed or formed in the receptacle body 60.

The receptacle body 60 includes a body bottom plate 61, a fence 62 formed by integrally extending upward from the body bottom plate 61, a mating cavity 64 provided in the fence 62, a terminal groove 63 penetrating the body bottom plate 61 and communicating with the mating cavity 64, and a bottom plate extending portion 65 formed by extending outward from the body bottom plate 61.

The fence 62 is cut in an extending direction of the receptacle terminal 70 to form a plurality of matching grooves 67 for receiving the shielding body 31 of each of the metal spacers 30. The matching groove 67 penetrates through the fence 62 and passes through the mating cavity 64 in the extending direction of the receptacle terminal 70.

The receptacle terminal 70 is integrally formed in the terminal groove 63, the receptacle terminal 70 includes a second welding pin 71, a second U-shaped contact portion 73 formed by being bent multiple times from one end of the second welding pin 71, and an end 74 formed by being reversely bent from a tip end of the second U-shaped contact portion 73. The second U-shaped contact portion 73 is in buckling contact with the first U-shaped contact portion 43 of the plug terminal 40, and the second U-shaped contact portion 73 includes two other contact portions 75, 76 that are in electrical contact with the two contact portions 42, 44 of the first U-shaped contact portion 43. There is a gap between the second U-shaped contact portion 73 and the receptacle body 60, so that the second U-shaped contact portion 73 can be elastic. The two contact portions 75, 76 of the second U-shaped contact portion 73 are located on opposite wall surfaces of the mating cavity 64, and the island portion 23 of the plug body 20 is inserted into the mating cavity 64, so that the contact portions 42, 44 of the first U-shaped contact portion 43 on an outer surface of the island portion 64 are in electrical contact with the contact portions 75, 76 of the second U-shaped contact portion 73 on an inner surface of the mating cavity 64. The shielding body 31 of the metal spacer 30 is inserted into the matching groove 67.

The receptacle fixing member 80 is integrally formed on the bottom plate extending portion 65. The receptacle fixing member 80 includes a frame structure 81, a welding portion 83 formed by extending from bottom of the frame structure 81, and second buckling portions 84 provided at four corners of the frame structure 81. The second buckling portions 84 are buckled with the first buckling portions 181 at four corners of the fixing outer frame 31 of the plug fixing member 30. The frame structure 81 is cut out at a position corresponding to the second welding pin 71 to form a notch 82, in order to facilitate the second welding pin 71 to extend out of the receptacle body 60. An accommodation gap 66 is formed between the fence 62 of the receptacle body 60 and the frame structure 81, the body outer-wall 22 of the plug body 20 and the fixed outer frame 31 of the plug fixing member 30 are inserted into the accommodating gap 66, and the fixing outer frame 31 and the frame structure 81 are in electrical contact to be grounded, forming closed shielding space.

It should also be noted that the terms "include", "comprise" or any other variants thereof are intended to cover non-exclusive inclusion, so that a process, method, product or equipment that includes a series of elements not only includes those elements but also includes other elements not explicitly listed, or also includes elements inherent to the process, method, commodity, or equipment. If there are no more restrictions, an element defined by a sentence "including a/an . . . " does not exclude existence of other identical elements in the process, method, product, or equipment that includes the element.

The above descriptions are merely embodiments of the present disclosure and are not intended to limit the present disclosure. For those skilled in the art, the present disclosure can have various modifications and changes. Any modification, equivalent replacement, improvement, etc. made within the principle of the present disclosure shall be within a scope claimed by the present disclosure.

What is claimed is:

1. A board-to-board radio frequency plug, comprising:

a plug body;

a plurality of plug terminals and a plurality of metal spacers integrally formed in the plug body; and a shielding shell wrapping the plug body and the plurality of plug terminals, the plug body comprising:

a body base;

a body outer-wall formed by integrally extending upward from a periphery of the body base;

an island portion formed by integrally extending upward from middle of the body base; and an insertion space formed between the body outer-wall and the island portion;

wherein the plurality of plug terminals extend on an outer periphery of the island portion, each of the plurality of metal spacers is provided between two adjacent ones of the plurality of plug terminals, and each of the plurality of metal spacers penetrates through the island portion and the insertion space in a perpendicular direction;

wherein each of the plurality of plug terminals comprises a first welding pin and a first contact portion formed by being bent from an end of the first welding pin, the first contact portion is fixed to the island portion;

wherein each of the plurality of metal spacers comprises a shielding body located outside the first contact portion, an extending end extending from the shielding body to outside the first welding pin; and wherein each of the plurality of metal spacers completely shields interference between two adjacent ones of the plurality of plug terminals.

2. The board-to-board radio frequency plug according to claim 1, wherein an outer periphery of the body base extends outward to form a platform portion, a covering portion is formed on a side of the body base where the plug terminal extends out, and the body base extends on a side opposite to the covering portion to form a protruding portion.

3. The board-to-board radio frequency plug according to claim 2, wherein the shielding shell comprises a substrate, a first covering portion formed by being bent and extending in an opposite direction from a side of the substrate, and a cover plate parallel to the substrate and formed by being bent and extending perpendicularly from the first covering portion; an opening is formed in the cover plate, and a periphery of the opening is provided, by stamping, with a protective portion wrapping an outer periphery of the body outer-wall; and four corners of the protective portion is further provided with first buckling portions.

4. The board-to-board radio frequency plug according to claim 3, wherein the shielding shell further comprises a second covering portion formed by being perpendicularly bent and extending from a lateral outer side of the substrate toward the cover plate, the opening formed in the cover plate and configured for exposing the plug body and the plurality of plug terminals of the plug to outside, and cable clamps formed outside of the substrate and the cover plate by stamping.

5. The board-to-board radio frequency plug according to claim 4, wherein the second covering portion comprises a vertical covering portion formed by being perpendicularly bent from the substrate, and a buckling portion which is overlapped on lateral two sides of an upper surface of the cover plate and formed by being perpendicularly bent and extending from a tip end of the vertical covering portion; and the buckling portion is located on outside of the protective portion and cut to form an avoiding portion, and the avoiding portion extends on two sides to form buckling protrusions, so as to enhance buckling firmness of the shielding shell.

6. The board-to-board radio frequency plug according to claim 2, wherein the first contact portion is a first U-shaped contact portion, the first U-shaped contact portion is buckled outside the island portion, and the first U-shaped contact portion comprises two contact portions located on an outer surface of a vertical portion of the island portion, and a hook portion embedded in the island portion in a direction perpendicular to a plug-in direction.

7. The board-to-board radio frequency plug according to claim 6, wherein the extending end of each of the plurality of metal spacers extends from the shielding body to the covering portion, and each of the plurality of metal spacers further comprises a positioning end extending from the shielding body toward the protruding portion; and the shielding body penetrates through the island portion in the perpendicular direction and completely isolates the insertion space in the perpendicular direction.

8. The board-to-board radio frequency plug according to claim 7, wherein a plurality of groove structures for receiving the first welding pins of the plurality of plug terminals are provided at a top of the covering portion, and each of the plurality of groove structures corresponds to a respective one of the first welding pins; and a baffle is formed between the groove structures, the first welding pin extends from a side of the body base to the groove structure of the covering portion, and the extending end of the metal spacer is formed in the baffle.

9. The board-to-board radio frequency plug according to claim 8, wherein central conductors of a plurality of coaxial cables are welded to the first welding pins in the plurality of groove structures, an insulating bar is pressed over the plurality of groove structures, and the insulating bar and the covering portion are sandwiched and fixed by the substrate and the cover plate.

10. The board-to-board radio frequency plug according to claim 7, wherein the plurality of the metal spacers are connected into one piece through a material strip through the positioning ends, which are formed in the protruding portion of the plug body, and after injection molding, the connected material strip is cut out, so that the plurality of metal spacers are electrically isolated from each other.

11. A board-to-board radio frequency plug, comprising:

a plug body;

a plurality of plug terminals and a plurality of metal spacers integrally formed in the plug body; and a shielding shell wrapping the plug body and the plurality of plug terminals, the plug body comprising:

a body base;

a body outer-wall formed by integrally extending upward from a periphery of the body base;

an island portion formed by integrally extending upward from middle of the body base; and an insertion space formed between the body outer-wall and the island portion;

wherein the plurality of plug terminals extend on an outer periphery of the island portion;

the shielding shell comprises a substrate, a first covering portion formed by being reversely bent and extending from a side of the substrate, and a cover plate parallel to the substrate and formed by being bent and extending perpendicularly from the first covering portion;

wherein an opening is formed in the cover plate, and a periphery of the opening is provided, by stamping, with a protective portion wrapping an outer periphery of the body outer-wall;

wherein four corners of the protective portion are further provided with first buckling portions;

wherein each of the plurality of metal spacers is provided between two adjacent ones of the plurality of plug terminals, and each of the plurality of metal spacers penetrate through the island portion and the insertion space in a perpendicular direction;

wherein each of the plurality of plug terminals comprises a first welding pin and a first contact portion formed by being bent from an end of the first welding pin, the first contact portion is fixed to the island portion;

wherein each of the plurality of metal spacers comprises a shielding body located outside the first contact portion, an extending end extending from the shielding body to outside the first welding pin; and wherein each of the plurality of metal spacers completely shields interference between two adjacent ones of the plurality of plug terminals.

12. The board-to-board radio frequency plug according to claim 11, wherein an outer periphery of the body base extends outward to form a platform portion, a covering portion is formed on a side of the body base where the plug terminal extends out, and the body base extends on a side opposite to the covering portion to form a protruding portion.

13. The board-to-board radio frequency plug according to claim 11, wherein the shielding shell further comprises a second covering portion formed by being perpendicularly bent and extending from a lateral outer side of the substrate toward the cover plate, the opening formed in the cover plate and configured for exposing the plug body and the plurality of plug terminals of the plug to outside, and cable clamps formed outside of the substrate and the cover plate by stamping.

14. The board-to-board radio frequency plug according to claim 13, wherein the second covering portion comprises a vertical covering portion formed by being perpendicularly bent from the substrate, and a buckling portion which is overlapped on lateral two sides of an upper surface of the cover plate and formed by being perpendicularly bent and extending from a tip end of the vertical covering portion; and the buckling portion is located on outside of the protective portion and cut to form an avoiding portion, and the avoiding portion extends on two sides to form buckling protrusions, so as to enhance buckling firmness of the shielding shell.

15. The board-to-board radio frequency plug according to claim 12, wherein the first contact portion is a first U-shaped contact portion, the first U-shaped contact portion is buckled outside the island portion, and the first U-shaped contact portion comprises two contact portions located on an outer surface of a vertical portion of the island portion, and a hook portion embedded in the island portion in a direction perpendicular to a plug-in direction.

16. The board-to-board radio frequency plug according to claim 15, wherein the extending end of each of the plurality of metal spacers extends from the shielding body to the covering portion, and each of the plurality of metal spacers further comprises a positioning end extending from the shielding body toward the protruding portion; the shielding body penetrates through the island portion in the perpendicular direction and completely isolates the insertion space in the perpendicular direction; the plurality of the metal spacers are connected into one piece through a material strip through the positioning ends, which are formed in the protruding portion of the plug body, and after injection molding, the connected material strip is cut out, so that the plurality of metal spacers are electrically isolated from each other.

17. The board-to-board radio frequency plug according to claim 16, wherein a plurality of groove structures for receiving the first welding pins of the plurality of plug terminals are provided at top of the covering portion, and each of the plurality of groove structures corresponds to a respective one of the first welding pins; and a baffle is formed between the groove structures, the first welding pin extends from a side of the body base to the groove structure of the covering portion, and the extending end of the metal spacer is formed in the baffle.

18. The board-to-board radio frequency plug according to claim 17, wherein central conductors of a plurality of coaxial cables are welded to the first welding pins in the plurality of groove structures, an insulating bar is pressed over the plurality of groove structures, and the insulating bar and the covering portion are sandwiched and fixed by the substrate and the cover plate.

19. A board-to-board radio frequency receptacle matched with a board-to-board radio frequency plug, wherein the board-to-board radio frequency plug comprises:

a plug body;

at least two plug terminals and at least one metal spacer integrally formed in the plug body; and a shielding shell wrapping the plug body and the at least two plug terminals, the plug body comprising:

a body base;

an island portion formed by integrally extending upward from middle of the body base; and an insertion space formed between the shielding shell and the island portion, wherein the at least two plug terminals extend on an outer periphery of the island portion, each of the at least one metal spacer is provided between two adjacent ones of the at least two plug terminals, and each of the at least one metal spacer penetrates through the insertion space in a perpendicular direction;

wherein each of the plurality of plug terminals comprises a first welding pin and a first contact portion formed by being bent from an end of the first welding pin, the first contact portion is fixed to the island portion;

wherein each of the plurality of metal spacer comprises a shielding body located outside the first contact portion, an extending end extending from the shielding body to outside the first welding pin;

wherein each of the plurality of metal spacer completely shields interference between two adjacent ones of the plurality of plug terminals, wherein the board-to-board radio frequency receptacle comprises:

a receptacle body;

a receptacle fixing member integrally formed on the receptacle body; and a receptacle terminal provided in the receptacle body, the receptacle body comprising:

a body bottom plate;

a fence formed by integrally extending upward from the body bottom plate;

a mating cavity provided in the fence;

a terminal groove penetrating through the body bottom plate and communicating with the mating cavity; and a bottom plate extending portion formed by extending outward from the body bottom plate;

wherein the fence is cut in an extending direction of the receptacle terminal to form a plurality of matching grooves, and each of the plurality of matching grooves penetrates through the fence and passes through the mating cavity in the extending direction of the receptacle terminal;

wherein the receptacle terminal is integrally formed in the terminal groove, the receptacle terminal comprises a second welding pin, a second contact portion formed by being bent multiple times from one an end of the second welding pin, an end formed by being reversely bent from a tip end of the second contact portion;

wherein two contact portions of the second contact portion are located on opposite wall surfaces of the mating cavity;

wherein the receptacle fixing member comprises a frame structure, a welding portion formed by extending from bottom of the frame structure, and second buckling portions provided at four corners of the frame structure; and wherein an accommodation gap is formed between the fence of the receptacle body and the frame structure.

20. A board-to-board radio frequency plug, comprising:

a plug body;

at least two plug terminals and at least one metal spacer integrally formed in the plug body; and a shielding shell wrapping the plug body and the at least two plug terminals, the plug body comprising:

a body base;

an island portion formed by integrally extending upward from a middle of the body base; and an insertion space formed between the shielding shell and the island portion;

wherein the at least two plug terminals extend on an outer periphery of the island portion, each of the at least one metal spacer is provided between two adjacent ones of the at least two plug terminals, and each of the at least one metal spacer penetrates through the insertion space in a perpendicular direction;

wherein each of the plurality of plug terminals comprises a first welding pin and a first contact portion formed by being bent from an end of the first welding pin, the first contact portion is fixed to the island portion;

wherein each of the at least one metal spacer comprises a shielding body located outside the first contact portion, an extending end extending from the shielding body to outside the first welding pin; and wherein each of the at least one metal spacer completely shields interference between two adjacent ones of the plurality of plug terminals.

* * * * *